US008897478B2

(12) United States Patent
Yang

(10) Patent No.: US 8,897,478 B2
(45) Date of Patent: Nov. 25, 2014

(54) EARPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 14/014,373

(22) Filed: Aug. 30, 2013

(65) Prior Publication Data

US 2014/0286521 A1 Sep. 25, 2014

(30) Foreign Application Priority Data

Mar. 20, 2013 (TW) ..... 102109840 A

(51) Int. Cl.
*H04R 25/00* (2006.01)
*H04R 1/10* (2006.01)

(52) U.S. Cl.
CPC ..... *H04R 1/1041* (2013.01)
USPC ..... 381/373; 381/370; 381/372

(58) Field of Classification Search
CPC ..... H04R 1/1041; H04R 1/1008
USPC ..... 381/370–374, 376–380; 379/430; 455/575.2
See application file for complete search history.

(56) References Cited

U.S. PATENT DOCUMENTS 6,826,287 B2 * 11/2004 Myers ..... 381/373
7,391,878 B2 * 6/2008 Liao ..... 381/370
8,515,116 B2 * 8/2013 Lee ..... 381/380

* cited by examiner

*Primary Examiner* — Tuan D Nguyen
(74) *Attorney, Agent, or Firm* — Jianq Chyun IP Office

(57) ABSTRACT

An earphone including a housing, a speaker, a tuning mechanism and an acoustic damper is provided. The housing has a sound-output opening. The speaker is disposed at the sound-output opening. The speaker and the housing together define a compartment. The speaker has an inner chamber and a through hole for communicating the inner chamber and the compartment. The tuning mechanism is movably disposed at the housing and extended into the compartment. The acoustic damper is disposed between the tuning mechanism and the speaker, and located at the through hole. The tuning mechanism is configured to move to compress or release the acoustic damper for adjusting the air permeability of the acoustic damper.

10 Claims, 5 Drawing Sheets

EARPHONE

CROSS-REFERENCE TO RELATED APPLICATION

This application claims the priority benefit of Taiwan application serial no. 102109840, filed on Mar. 20, 2013. The entirety of the above-mentioned patent application is hereby incorporated by reference herein and made a part of this specification.

FIELD OF THE INVENTION

The present invention relates to an earphone, and more particularly, to the one that has a sound tuning function.

DESCRIPTION OF RELATED ART

With the rapid progress in science and technology, all electronic products have been developed towards light, handy and miniaturized designs. People may use miniaturized electronic products, such as radios or walkmans, anytime and anywhere. Moreover, since personal digital products gradually become popular, products such as common MP3 walkmans, cellular phones, personal digital assistants (PDA) or notebooks, have even grown to be indispensable in our daily life. In addition, the cell phone integrated with functions of both radio and MP3 has come out.

For each of those aforementioned electronic products, in order to allow a user to listen to the audio information provided by the electronic product without disturbing the other people around, an earphone has become a necessary accessory to the electronic product. Moreover, the earphone also provides a listener better audio transmission so that the listener can clearly hear and understand content of the audio information. In contrast to unclear audio transmission through the air, especially when the listener is moving, for example like doing exercises, driving, intensely moving around or being in a noisy environment, the audio transmission of the earphone still would not be affected.

However, since the size and structure of the ear and the ear canal are different from person to person, and a different person has a different favor for the music, thus, the judgment for the sound quality of the earphone varies as for different persons, and it is hard to meet the requirements of every single person. Meanwhile, the frequency response curve of most earphones available in the market is fixed, and if the frequency response on high tone portion or low tone portion of the signal is to be changed, it requires changing the distribution characteristics of the sound field by an electronic equalizer or relevant software. Even though the additional electronic equalizer may change the frequency response of the earphone, the time delay caused by the inductance or capacitance within the electronic equalizer cannot be compensated. Therefore, it is an unavoidable task to improve the structure of the earphone.

SUMMARY OF THE INVENTION

The present invention describes an earphone capable for adjusting the sound field characteristic in the structure of the earphone.

The present invention provides an earphone including a first housing, a speaker, a tuning mechanism and a porous material. The first housing has a sound-output opening. The speaker is disposed at the sound-output opening, and the speaker and the first housing together define a compartment.

The speaker has an inner chamber and a through hole, wherein the through hole is used for communicating the inner chamber and the compartment. The tuning mechanism is movably disposed at the first housing and extended into the compartment. The porous material is disposed between the tuning mechanism and the speaker and located at the through hole. The tuning mechanism is configured to move to compress or release the porous material for adjusting an air permeability of the porous material.

The present invention further provides an earphone including a first housing, a speaker, a second housing and a tuning mechanism. The first housing has a sound-output opening. The speaker is disposed at the sound-output opening, wherein the speaker and the first housing together define a compartment, the speaker has an inner chamber and a through hole, and the through hole is used for communicating the compartment and the inner chamber. The second housing is located in the compartment and covering the speaker, wherein the compartment is partitioned into a front chamber and a back chamber by the second housing, and the second housing has a tuning hole. The tuning mechanism is movably disposed at the first housing and extended into the back chamber. The porous material is disposed between the tuning mechanism and the second housing and located at the tuning hole, wherein the tuning mechanism is configured to move to compress or release the porous material for adjusting the air permeability of the porous material.

According to one exemplary embodiment of the present invention, the tuning mechanism includes a control button and a propping portion. The control button protrudes to the outside of the first housing. The propping portion is extended into the compartment. The control button is connected to the propping portion for driving the propping portion to move.

According to one exemplary embodiment of the present invention, the porous material is disposed on the speaker.

According to one exemplary embodiment of the present invention, the porous material is an annular shape and surrounds the through hole.

According to one exemplary embodiment of the present invention, the earphone further includes a second housing located in the compartment and covering the speaker, wherein the compartment is partitioned into a front chamber and a back chamber by the second housing. The second housing has a tuning hole.

According to one exemplary embodiment of the present invention, the tuning mechanism includes a control button and a propping portion. The control button protrudes to the outside of the first housing. The propping portion is extended into the back chamber. The control button is connected to the propping portion for driving the propping portion to move.

According to one exemplary embodiment of the present invention, the porous material is disposed on the second housing.

According to one exemplary embodiment of the present invention, the porous material is an annular shape and surrounds the tuning hole.

According to one exemplary embodiment of the present invention, the porous material is a sponge.

In light of the above, since the sound field characteristic may be different due to the air permeability of the through hole which communicates the inner chamber of the speaker and the compartment of the first housing, the air permeability of the porous material is changed by compressing or releasing the porous material located at the through hole by using the tuning mechanism in the present invention, and the air permeability of the through hole is further changed. Therefore, each person may adjust the frequency response and the sound field characteristic of the earphone through the tuning mechanism according to the user's preference, such that the earphone can meet different users' requirements and it enhances the performance of the earphone.

To make the above features and advantages of the present invention more comprehensible, several embodiments accompanied with drawings are described in detail as follows.

DESCRIPTION OF EMBODIMENTS

Figure 1:
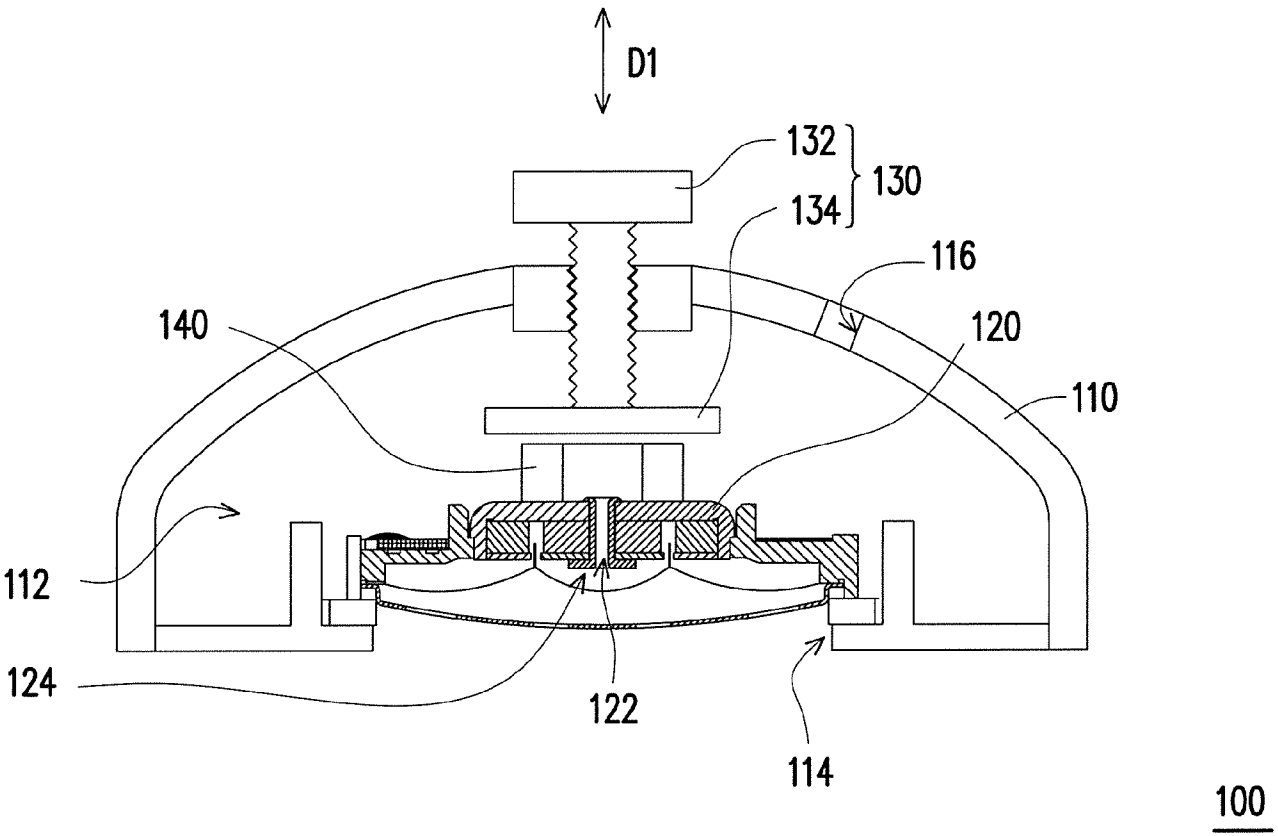
FIG. 1 is a schematic cross-sectional view of an earphone illustrating a status of the porous material thereof not being compressed according to an embodiment of the present invention.
Figure 2:
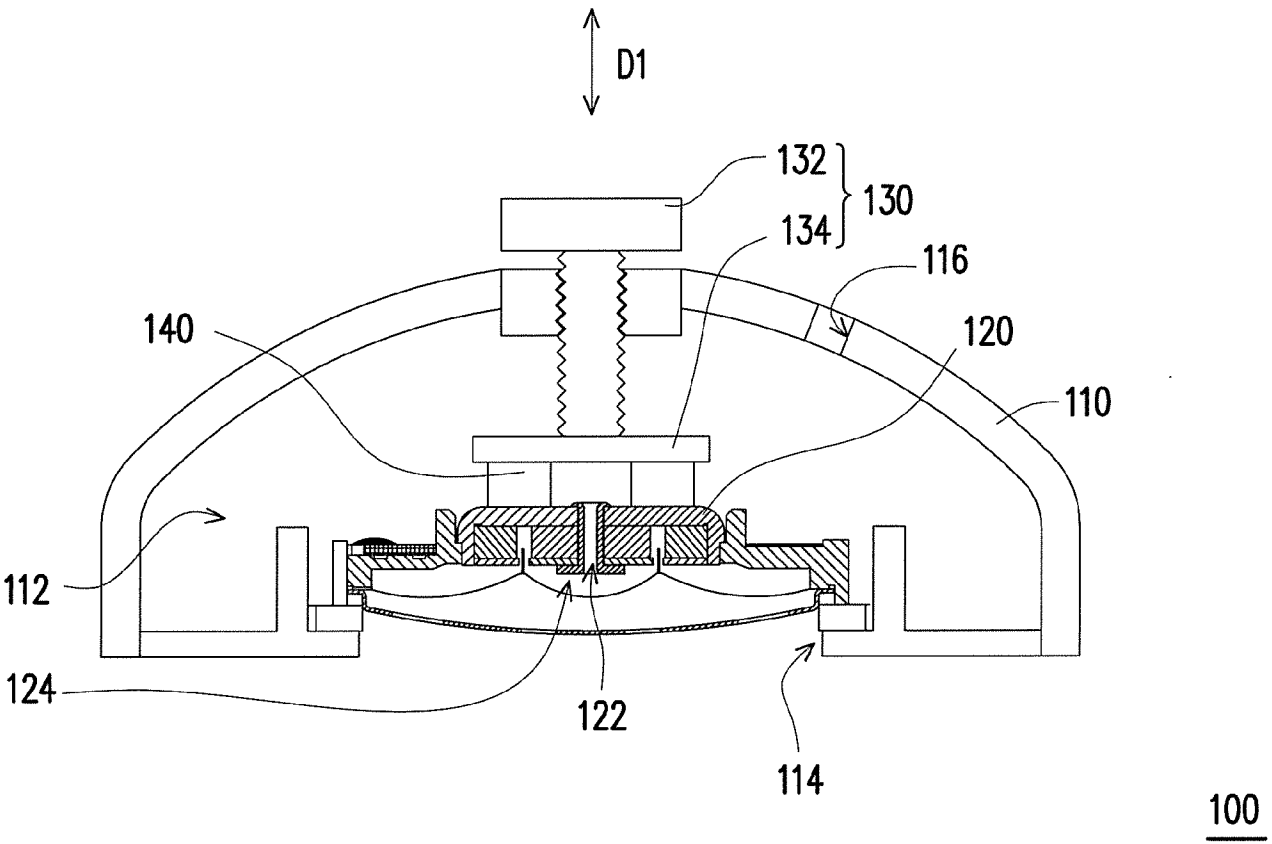
FIG. 2 is a schematic cross-sectional view of the earphone of FIG. 1 illustrating a status of the porous material thereof being compressed.

FIG. 1 is a schematic cross-sectional view of an earphone illustrating a status of the porous material thereof not being compressed according to an embodiment of the present invention. FIG. 2 is a schematic cross-sectional view of the earphone of FIG. 1 illustrating a status of the porous material thereof being compressed. Referring to FIG. 1 and FIG. 2 together, in the present embodiment, the earphone 100 includes a first housing 110, a speaker 120, a tuning mechanism 130 and a porous material 140. The first housing 110 has a sound-output opening 114. The speaker 120 is disposed at the sound-output opening 114, and the speaker 120 and the first housing 110 together define a compartment 112. In this embodiment, the compartment 112 together defined by the speaker 120 and the first housing 110 is used for generating a resonance effect. The speaker 120 has an inner chamber 124 and a through hole 122, wherein the through hole 122 is used for communicating the inner chamber 124 and the compartment 112 for adjusting the sound field characteristic of the earphone 100. In this embodiment, the first housing 110 further includes a vent 116 which communicates the compartment 112 and the outside of the first housing 110. The tuning mechanism 130 is movably disposed at the first housing 110 and extended into the compartment 112. The porous material 140 is disposed between the tuning mechanism 130 and the speaker 120 and located at the through hole 122. The tuning mechanism 130 is configured to move to compress or release the porous material 140 for adjusting an air permeability of the porous material 140. The porous material 140 of the embodiment serves as an acoustic damper of a common earphone. In the present embodiment, the porous material is a sponge or other porous materials.

In this embodiment, the porous material 140 is disposed on the speaker 120 as shown in FIG. 1, and the porous material 140 is an annular shape and surrounds the through hole 122, so that the through hole is not blocked up when the porous material is fixed on the through hole 122 of the speaker 120 through an adhesive. As such, the air permeability of the through hole 122 is changed with the air permeability of the porous material 140 surrounding and covering thereon. Undoubtedly, in other embodiments of the present invention, the porous material 140 can also be disposed on the tuning mechanism 130, for example, and disposed corresponding to the location of the through hole 122, so that when the tuning mechanism 130 moves toward or away from the speaker 120 along a tuning direction D1 as shown in FIG. 1 and FIG. 2, the porous material 140 covers the through hole 122 and the air permeability of the porous material 140 is changed through the compressing or releasing of the speaker 120, and the air permeability of the through hole 122 is further changed.

In detailed, the tuning mechanism 130 includes a control button 132 and a propping portion 134. The control button 132 protrudes to the outside of the first housing 110. The propping portion 134 is extended into the compartment 112, and the control button 132 is connected to the propping portion 134 and used for driving the propping portion 134 to move back and forth along the tuning direction D 1. In such configuration, the user can compress or release the porous material 140 through the control button 132 controlling the propping portion 134 to move toward the speaker 120 or move away from the speaker 120 along the tuning direction D1, so as to adjust the air permeability of the porous material 140.

For instance, when the user uses the control button 132 to control the propping portion 134 to move toward the speaker 120, the propping portion 134 compresses the porous material 140 as shown in FIG. 2, thus the air permeability of the compressed porous material 140 is reduced. Similarly, when the user uses the control button 132 to control the propping portion 134 to move away from the speaker 120, the propping portion 134 releases the compressed porous material 140, thus the air permeability of the released porous material 140 is increased.

In general, a through hole of a speaker with a smaller air permeability is more outstanding for the frequency response of the high-frequency portion, and a through hole of a speaker with a larger air permeability is more outstanding for the frequency response of the low-frequency portion. In other words, different air permeability of the through holes are different in the sound field characteristic and have their own particularity. Therefore, the tuning mechanism is used for compressing or releasing the porous material located at the through hole to change the air permeability of the through hole in the present invention. As such, the user can adjust the sound field characteristic of the earphone as required, thus the performance of the earphone is improved.

Figure 3:
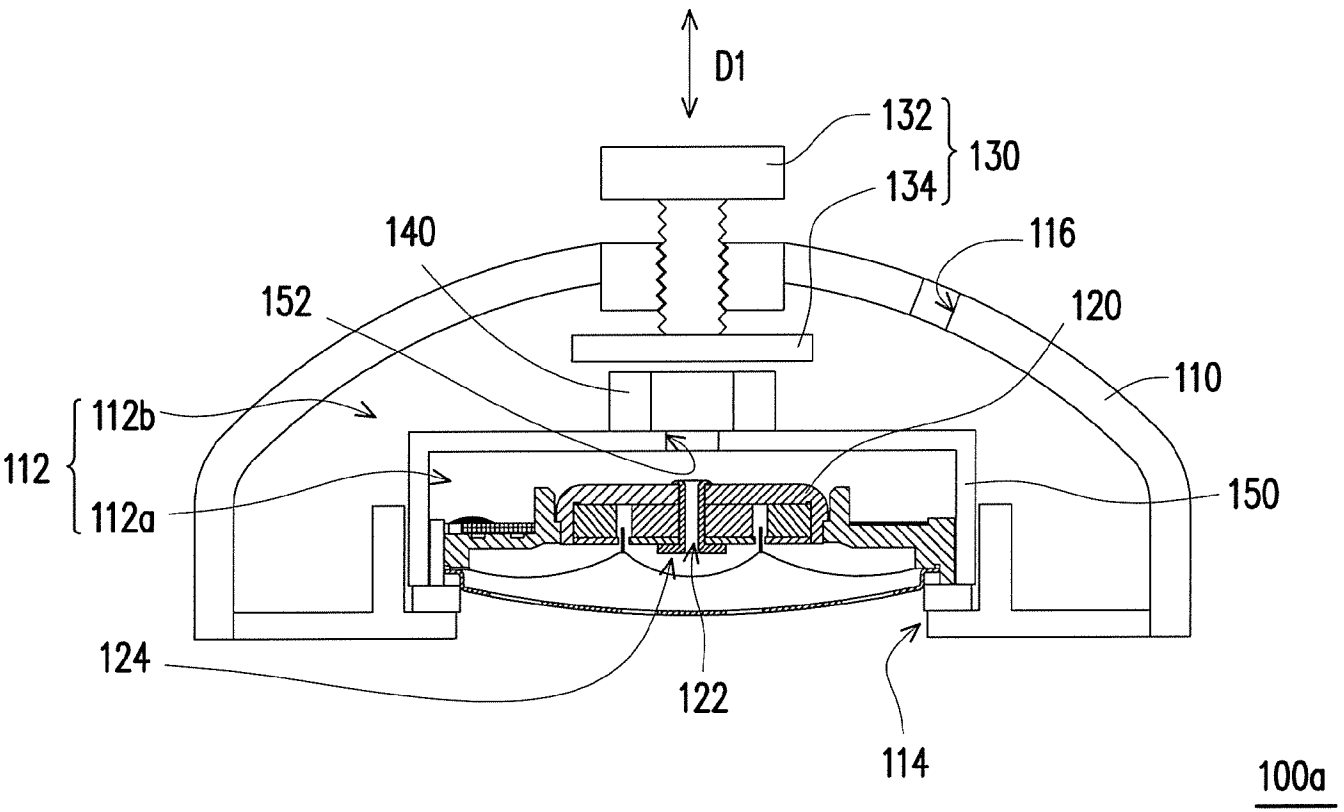
FIG. 3 is a schematic cross-sectional view of an earphone illustrating a status of the porous material thereof not being compressed according to another embodiment of the present invention.
Figure 4:
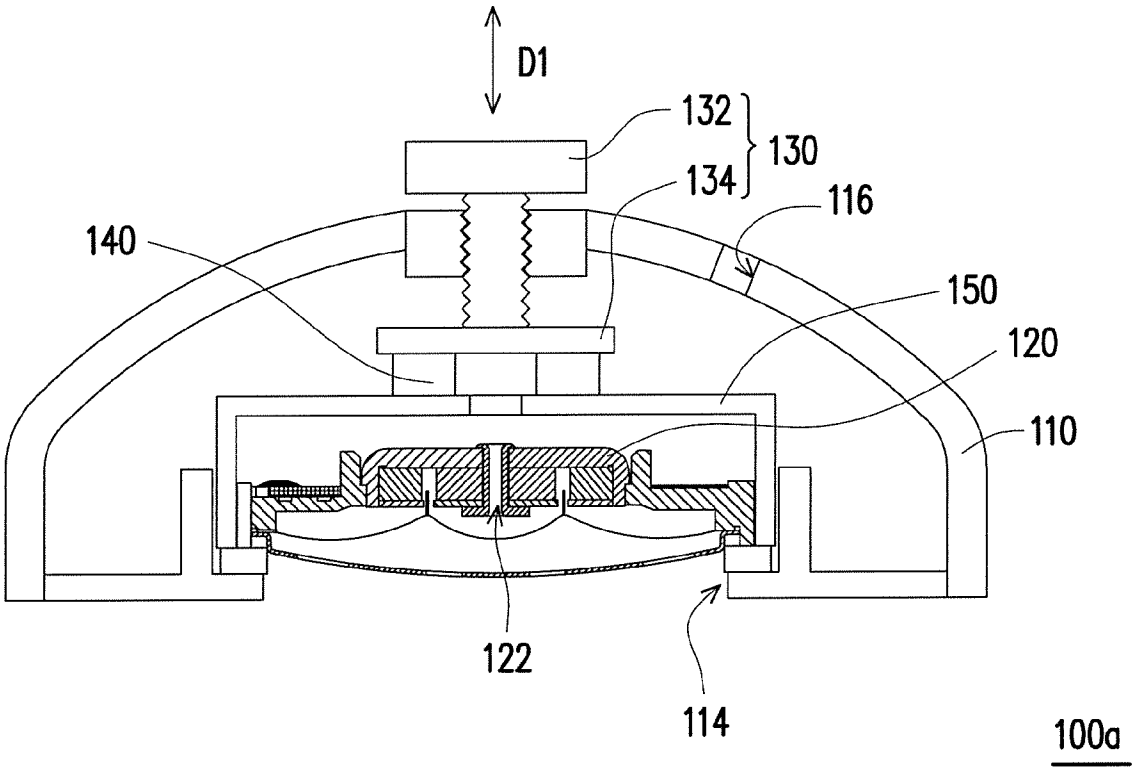
FIG. 4 is a schematic cross-sectional view of the earphone of FIG. 3 illustrating a status of the porous material thereof being compressed.

FIG. 3 is a schematic cross-sectional view of an earphone illustrating a status of the porous material thereof not being compressed according to another embodiment of the present invention. FIG. 4 is a schematic cross-sectional view of the earphone of FIG. 3 illustrating a status of the porous material thereof being compressed. It has to be mentioned that the earphone 100*a* of the present embodiment is substantially similar to the earphone 100 of FIG. 1 and FIG. 2. Therefore, reference numerals the same as that of the above embodiment are used in this embodiment to indicate similar components, and other similar features of the relevant technology will not be repeated herein any more. For a detailed description of this section, reference can be found in the abovementioned embodiment of the invention, therefore no further description is contained herein. Referring to FIG. 3 and FIG. 4 together, in the present embodiment, the earphone 100*a* further includes a second housing 150 located in the compartment 112 and covering the speaker 120, wherein the compartment 112 is partitioned into a front chamber 112*a* and a back chamber 112*b* by the second housing 150. The second housing 150 has a tuning hole 152, wherein the tuning hole 152 is used for communicating the front chamber 112*a* and the back chamber 112*b*, so as to adjust the sound field characteristic of the earphone 100*a*. The tuning mechanism 130 is movably disposed at the first housing 110 and extended into the back chamber 112*b*. The porous material 140 is disposed between the tuning mechanism 130 and the second housing 150 and is located at the tuning hole. The location of the tuning hole 152 may be, for example, aligned with the through hole 122, but the disclosure is not limited thereto. In other embodiment, the tuning hole 152 may also not be aligned with the through hole 122.

In this embodiment, the porous material 140 is disposed on the second housing 150 as shown in FIG. 3, and the porous material 140 is an annular shape and surrounds the tuning hole 152, so that the tuning hole 152 is not blocked up when the porous material 140 is fixed on the tuning hole 152 of the second housing 150 through an adhesive. As such, the air permeability of the tuning hole 152 is changed with the air permeability of the porous material 140 surrounding and covering thereon. Undoubtedly, in other embodiments of the present invention, the porous material 140 can also be disposed on the tuning mechanism 130, for example, and disposed corresponding to the location of the tuning hole 152, so that when the tuning mechanism 130 moves toward or away from the second housing 150, the porous material 140 covers the tuning hole 152 and the air permeability of the through hole 152 is further changed through the change of the air permeability of the porous material 140 by the compressing or releasing of the speaker 120.

In detailed, the tuning mechanism 130 includes a control button 132 and a propping portion 134. The control button 132 protrudes to the outside of the first housing 110, and the propping portion 134 is extended into the back chamber 112*b*. The control button 132 is connected to the propping portion 134 and used for driving the propping portion 134 to move back and forth along a tuning direction D1 as shown in FIG. 3 and FIG. 4. In such configuration, the user can compress or release the porous material 140 through the control button 132 controlling the propping portion 134 to move toward the second housing 150 or move away from the second housing 150 along the tuning direction D1, so as to adjust the air permeability of the porous material 140.

For instance, when the user uses the control button 132 to control the propping portion 134 to move toward the second housing 150, the propping portion 134 compresses the porous material 140 as shown in FIG. 4, thus the air permeability of the compressed porous material 140 is reduced. Similarly, when the user uses the control button 132 to control the propping portion 134 to move away from the second housing 150, the propping portion 134 releases the compressed porous material 140, thus the air permeability of the released porous material 140 is increased.

The earphone 100, 100*a* of the abovementioned embodiments can be a circum-aural earphone, wherein an arc-shaped pivoting frame is connected between the two earphone cups, and when it is worn by a user the two earphone cups cover the ears. This design can effectively insulate from external noise, thus a clear music can still be listened to even though the volume of the music is lower, and it may not cause damage to auditory nerves of the user. Obviously, the present invention is not limited to the present embodiment. In the following embodiments, the earphone can also be in-ear type earphone. In general, in-ear type earphone is that the size of the sound-output end is reduced and an earplug covers thereto, so that the sound-output end can be more deeply placed into the ear canal of the user, and elastic deformation of the earplug is used for fitting different ear canal profiles of users. A portion of the earplug of the in-ear type earphone would be placed in the ear canal of the user, and this is different than that the circum-aural earphone does not enter the ear canal of the user. This kind of earphone uses earplug to seal the ear canal of the user, so as to insulate from the external noise to improve audio quality.

Figure 5:
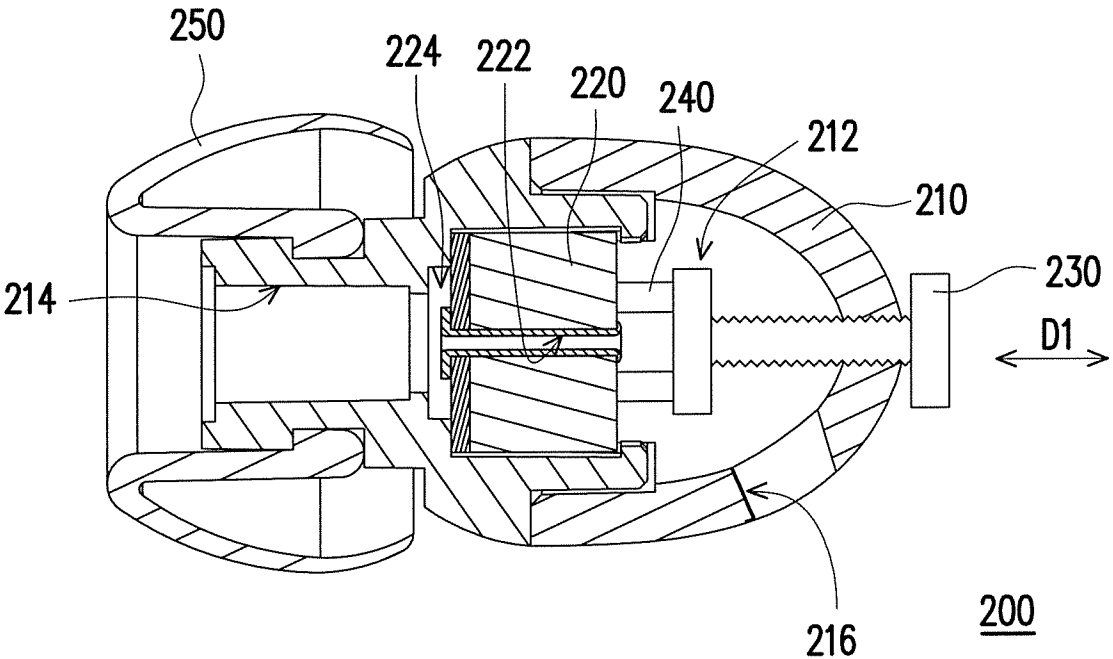
FIG. 5 is a schematic cross-sectional view of an earphone according to another embodiment of the present invention.

FIG. 5 is a schematic cross-sectional view of an earphone according to another embodiment of the present invention. In the present embodiment, the earphone 200 is an in-ear type earphone and includes a first housing 210, a speaker 220, a tuning mechanism 230, a porous material 240 and an earplug 250. The first housing 210 has a sound-output opening 214. The speaker 220 is disposed at the sound-output opening 214, and the speaker 120 and the first housing 210 together define a compartment 212. In the embodiment, the compartment 212 together defined by the speaker 220 and the first housing 210 is used for generating a resonance effect. The earplug 250 is disposed around the outside of the sound-output opening 214. The speaker 220 has an inner chamber 224 and a through hole 222, wherein the through hole 222 is used for communicating the inner chamber 224 and the compartment 212, so as to adjust the sound field characteristic of the earphone 200. In this embodiment, the first housing 210 further includes a vent 216 which communicates the compartment 212 and the outside of the first housing 210. The tuning mechanism 230 is movably disposed at the first housing 210 and extended into the compartment 212.

The porous material 240 is disposed between the tuning mechanism 230 and the speaker 220 and located at the through hole 222. The tuning mechanism 230 is configured to move to compress or release the porous material 240 for adjusting an air permeability of the porous material 240. As described in the abovementioned embodiments, the porous material 240 of the embodiment serves as an acoustic damper of a common earphone. In the present embodiment, the porous material is a sponge or other porous materials.

In the embodiment, the porous material 240 can be disposed on the speaker 220 as shown in FIG. 5, and the porous material 240 can be an annular shape and surround the through hole 222 as mentioned above. As such, the air permeability of the through hole 222 is changed with the air permeability of the porous material 240 surrounding and covering thereon. Undoubtedly, in the present embodiment, as described above, the porous material 240 can also be disposed on the tuning mechanism 230, and disposed corresponding to the location of the through hole 222, so that when the tuning mechanism 230 moves toward or away from the speaker 220 along a tuning direction D1 as shown in FIG. 5, the porous material 240 covers the through hole 222 and the air permeability of the porous material 240 is changed through the compressing or releasing of the speaker 220, and the air permeability of the through hole 222 is further changed.

In light of the foregoing, since the sound field characteristic may be different due to the air permeability of the through hole which communicates the inner chamber of the speaker and the compartment of the first housing, the air permeability of the porous material is changed by compressing or releasing the porous material located at the through hole by using the tuning mechanism in the present invention, and the air permeability of the through hole is further changed. Therefore, each person may adjust the frequency response and the sound field characteristic of the earphone through the tuning mechanism according to the user's preference, such that the earphone can meet different users' requirements and it enhances the performance of the earphone.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. An earphone, comprising:

a first housing having a sound-output opening;

a speaker disposed at the sound-output opening, wherein the speaker and the first housing together define a compartment, the speaker has an inner chamber and a through hole, and the through hole is used for communicating the compartment and the inner chamber;

a tuning mechanism movably disposed at the first housing and extended into the compartment; and a porous material disposed between the tuning mechanism and the speaker and located at the through hole, wherein the tuning mechanism is configured to move to compress or release the porous material for adjusting the air permeability of the porous material.

2. The earphone as claimed in claim 1, wherein the tuning mechanism comprises a control button and a propping portion, the control button protrudes to outside of the first housing, the propping portion is extended into the compartment, and the control button is connected to the propping portion for driving the propping portion to move.

3. The earphone as claimed in claim 2, wherein the porous material is disposed on the speaker.

4. The earphone as claimed in claim 1, wherein the porous material is an annular shape and surrounds the through hole.

5. The earphone as claimed in claim 1, wherein the porous material is a sponge.

6. An earphone, comprising:

a first housing having a sound-output opening;

a speaker disposed at the sound-output opening, wherein the speaker and the first housing together define a compartment, the speaker has an inner chamber and a through hole, and the through hole is used for communicating the compartment and the inner chamber;

a second housing located in the compartment and covering the speaker, wherein the compartment is partitioned into a front chamber and a back chamber by the second housing, and the second housing has a tuning hole;

a tuning mechanism movably disposed at the first housing and extended into the back chamber; and a porous material disposed between the tuning mechanism and the second housing and located at the tuning hole, wherein the tuning mechanism is configured to move to compress or release the porous material for adjusting the air permeability of the porous material.

7. The earphone as claimed in claim 6, wherein the tuning mechanism comprises a control button and a propping portion, the control button protrudes to outside of the first housing, the propping portion is extended into the back chamber, and the control button is connected to the propping portion for driving the propping portion to move.

8. The earphone as claimed in claim 6, wherein the porous material is disposed on the second housing.

9. The earphone as claimed in claim 6, wherein the porous material is an annular shape and surrounds the tuning hole.

10. The earphone as claimed in claim 6, wherein the porous material is a sponge.

* * * * *